United States Patent [19]

Kubelka et al.

[11] 4,154,009

[45] May 15, 1979

[54] INNER SHOE FOR SKIING BOOTS OR FOR USE WITH SHELLIKE UPPERS OF SKIING BOOTS

[75] Inventors: Axel Kubelka, Vienna; Adolf Hensler, Köflach, both of Austria

[73] Assignee: Koflach Sportgerate Gesellschaft m.b.H., Vienna, Austria

[21] Appl. No.: 820,006

[22] Filed: Jul. 28, 1977

[30] Foreign Application Priority Data

Aug. 4, 1976 [AT] Austria ..... 5783/76

[51] Int. Cl.[2] ..... A43B 5/04; A43B 19/00

[52] U.S. Cl. ..... 36/119; 36/71

[58] Field of Search ..... 36/117, 118, 119, 120, 36/121, 71, 88, 93, 10

[56] References Cited

U.S. PATENT DOCUMENTS

| | | | |
|---|---|---|---|
| 3,482,336 | 12/1969 | Gleisner | 36/119 |
| 3,535,800 | 10/1970 | Stohr | 36/120 |
| 3,896,202 | 7/1975 | Palav | 36/117 X |

FOREIGN PATENT DOCUMENTS

| | | | |
|---|---|---|---|
| 2292442 | 6/1976 | France | 36/120 |

*Primary Examiner*—Patrick D. Lawson

*Attorney, Agent, or Firm*—Cushman, Darby & Cushman

[57] ABSTRACT

An inner shoe for skiing boots or for use with shellike uppers of skiing boots, which inner shoe comprises a wall which consists at least in part of porous, e.g., foamed, particularly closed-cell elastic material, preferably plastics material, such as polyurethane, polyisoprene or polybutadiene, characterized in that the wall is peripherally entirely closed and has above the sole adjacent to the heel and/or instep of the foot portion which extends as far as to the upper edge of the inner shoe and has in the peripheral direction a higher extensibility, than the remaining portions of said wall, and in that that portion of said wall which has a higher extensibility is divided into laminations, which extend transversely to the peripheral direction and are joined in alternation on the inside and outside of the inner shoe to form accordion folds.

17 Claims, 16 Drawing Figures

INNER SHOE FOR SKIING BOOTS OR FOR USE WITH SHELLIKE UPPERS OF SKIING BOOTS

This invention relates to an inner shoe for skiing boots or for use with shellike uppers for skiing boots, which inner shoe comprises a wall which consists at least in part of porous, i.e., foamed, particularly closed-cell elastic material, preferably plastic material, such as polyurethane, polyisoprene or polybutadiene. Known inner shoes of that kind have a step-in opening which is covered by a tongue. The tongue has the disadvantage that it can easily slip toward the side so that the foot is no longer a good fit in the skiing boot and may be subjected to local pressure. When the wall of the inner shoe consists of closed-cell material, the wall is water-tight. On the other hand, when there is a step-in opening covered by a tongue, water can enter between the wall and the tongue.

It is an object of the invention to eliminate these disadvantages. The invention resides essentially in that the wall is peripherally entirely closed and has above the sole adjacent to the heel and/or instep of the foot a portion which extends as far as to the upper edge of the inner shoe and has in the peripheral direction a higher extensibility than the remaining portions of said wall and in that that portion of said wall which has a higher extensibility is divided into laminations, which extend transversely to the peripheral direction and are joined in alternation on the inside and outside of the inner shoe to form accordion folds. Because the wall has a portion which extends as far as to the upper edge of the inner shoe and has a higher extensibility, the inner shoe can be expanded to such an extent that there is no need for a step-in opening and for a tongue covering such step-in opening. Since the wall of the inner shoe is closed in itself as far as to the upper edge of the inner shoe, there are no passages which would permit of an ingress of water, such as exist at a step-in opening provided with a tongue. To enable the stepping of a foot into the inner shoe, the higher extensibility is mainly required in that portion which is adjacent to the heel of the foot. For this reason it will be sufficient to provide the inner shoe with a portion having a higher extensibility only adjacent to the heel of the foot. The division of the portion having a higher extensibility into laminations which extend transversely to the peripheral direction and are joined in alternation on the inside and outside of the inner shoe to form accordion folds affords the advantage that these portions may have substanially the same compressibility as the remaining portions of the inner shoe. For this reason, the special design of the extensible portions does not weaken the material. Because these portions of the inner shoe are located adjacent to portions of the foot which are relatively highly sensitive to pressure, this substantially uniform compressibility is of high significance for the wearing comfort. In order to completely preserve the cushioning properties in the resilient portions, the laminations when relaxed can be in sealing contact with each other at least on the inside of the inner shoe. The laminations may consist of the same material as the other wall portions of the inner shoe. In that case the laminated portion and the remaining portions of the inner shoe have substantially the same compressibility. On the other hand, the compressibility may be selected as desired and independently of the extensibility. In that case the portion having a higher extensibility consists of a material which has the same compressibility as the material of the remaining wall portions of the inner shoe and consists preferably of the same material as said remaining wall portions, and the higher extensibility of that portion is due to the local portions having a smaller wall thickness. If the portion having a higher extensibility is disposed in the rear part of the inner shoe, the portion having a higher extensibility will suitably extend along the Achilles' tendon only as far as the upper portion of the heel of the foot because this is sufficient for enabling the foot to step into the inner shoe and the firm fit of the heel of the foot will not be adversely effected by that design. In a desirable arrangement, that portion of the wall which has a higher extensibility may consist of a separate part and the inner shoe may have an aperture which conforms to said separate part having a higher extensibility, and said part is received in said aperture and joined to the edges thereof, e.g. by stitching or welding.

In a preferred embodiment of the invention, the laminations are defined by slots which have a depth that is smaller than the thickness of the wall. As a result, the wall has a certain remaining thickness at the bottom of the slot so that watertightness is ensured also at the bottom of the slot, and the laminations are joined at the bottom of the slot so that the laminations when relaxed automatically contact each other and the skiing boot can then be put on without difficulty.

Within the scope of the invention, a lining of flexible material may be provided at least on the inside of the inner shoe and may cover the laminations and line the slots. This lining affords the usual advantage of improving the comfort of the foot and the important additional advantage that the extension of the laminated portion is limited by the lining so that said portion cannot be torn even by rough usage. The slot is suitably enlarged in width near its bottom by the provision of grooves, which are suitably rounded in cross-section. These grooves afford the advantage that a danger of tearing at the bottom of the slot is reduced.

When the portion having a high extensibility is disposed at the rear of the inner shoe, the arrangement may be such that the slots extend adjacent to the Achilles' tendon only on the right and left of the latter and the wall comprises a vertical strip which is free from slots and extends along the Achilles' tendon. This design results in a softer cushioning of the foot at the Achilles' tendon, which is the most delicate portion at the rear of the foot. Because the foot is less delicate at the rear near the Achilles' tendon than adjacent to the instep, a laminated portion having a higher extensibility is desirably disposed at the rear even when the step-in opening formed in the shellike upper is disposed adjacent to the instep.

The laminations when relaxed are desirably in sealing contact with each other on the inside and preferably also on the outside of the inner shoe. It is also within the scope of the invention, however, to provide laminations which gape on the outside.

In an alternative arrangement, that wall portion which has a higher extensibility has slots which are arranged in rows transversely to the peripheral direction and are separated by webs, the depth of these slots is smaller than the wall thickness, the webs between slots of adjacent rows are staggered, and the slots of adjacent rows extend in alternation from the inside and outside of the wall. Such staggered slots provide for a high extensibility in a direction which is transverse to the rows of slots. Because the depth of the slots is smaller than the wall thickness, the portion is impermeable to water.

Within the scope of the invention, the inner shoe consists preferably of foamed plastics material, which has been injected into a mold in contact with any lining which is provided. Such design, which is known per se, permits of a simple manufacture and affords also the advantage that the foamable plastics material forms an outer skin in the mold into which it is injected and the watertightness us improved by such skin.

When it is desired to wear the inner shoe outside the shellike upper, e.g. in a mountain hut or during après-ski activities, the portion having the higher extensibility will adversely affect the fit of the foot. For this reason, it will be within the scope of the invention to provide a bandage, which surrounds the inner shoe above the instep and which may consist of a band provided with a bur fastener. Such bandage may also be desirable for closing the inner shoe within the shellike upper or skiing boot.

Embodiments of the invention are shown diagrammatically and by way of example on the drawing, in which FIG. 1 shows an inner shoe having a laminated rear portion, FIG. 2 shows an inner shoe having a laminated instep portion, FIG. 3 shows an inner shoe having a laminated rear portion and a laminated instep portion, FIG. 4 shows an inner shoe which has an opening for receiving a laminated portion as shown in FIG. 5.

Figure 1:
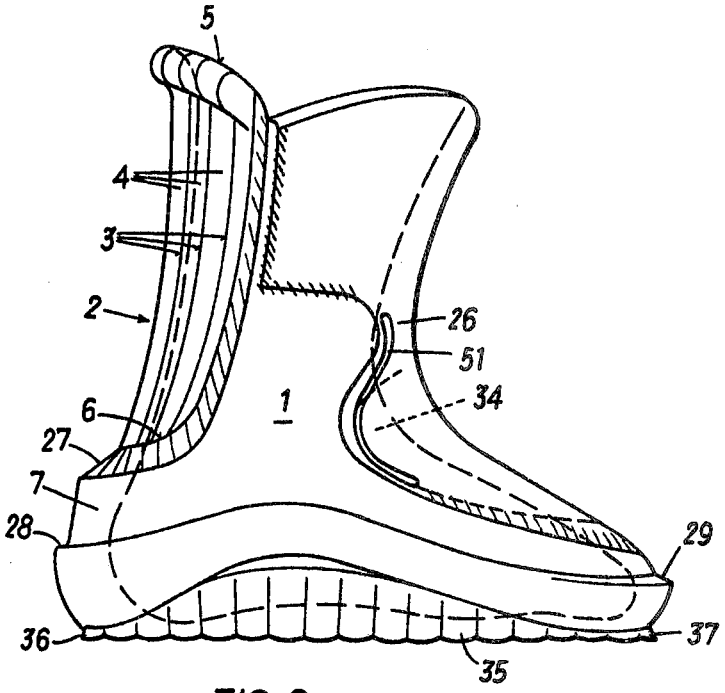

The inner shoe shown in FIG. 1 has adjacent to the Achilles' tendon a portion 2 which has a higher extensibility than the remaining wall portions 1 of the inner shoe. The wall portion 2 is divided by slots into laminations 4, which extend as far as to the upper edge 5 of the inner shoe and terminate adjacent to the upper portion 6 of the heel 7 of the foot.

Figure 2:
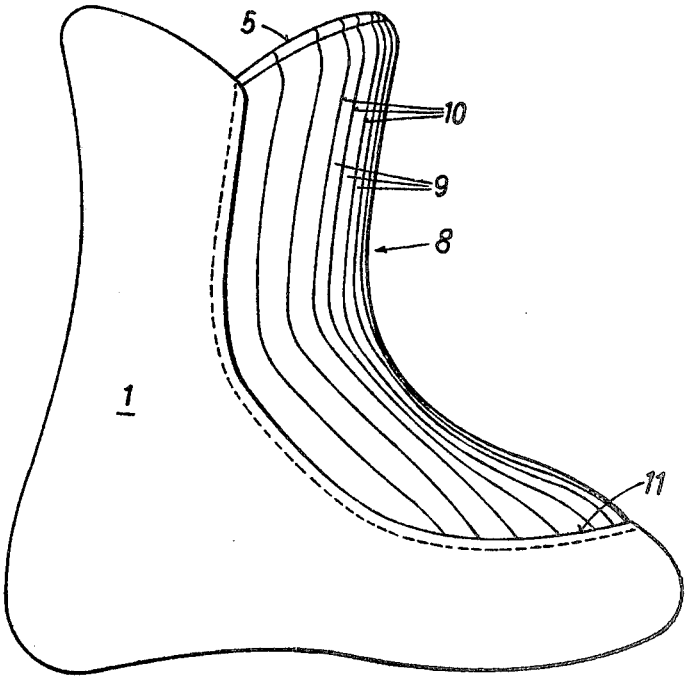

In the inner shoe shown in FIG. 2, that portion 8 which has a higher extensibility than the remaining wall portions 1 of the inner shoe is the instep portion. The portion 8 consists again of laminations 9, which are separated by slots 10. These laminations 9 and slots 10 extend from the upper edge 5 of the inner shoe as far as to the toe portion 11.

Figure 3:
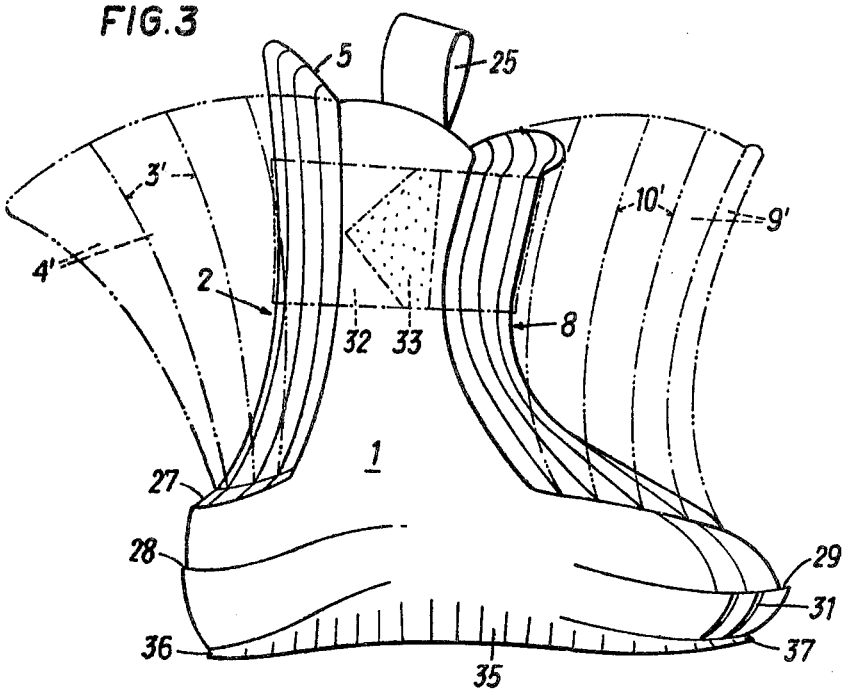

The inner shoe shown in FIG. 3 has a laminated portion 2 at the rear, adjacent the Achilles' tendon, and a laminated instep portion 8. These portions 2 and 8 having a higher extensibility are arranged like those shown in FIGS. 1 and 2.

Figure 4:
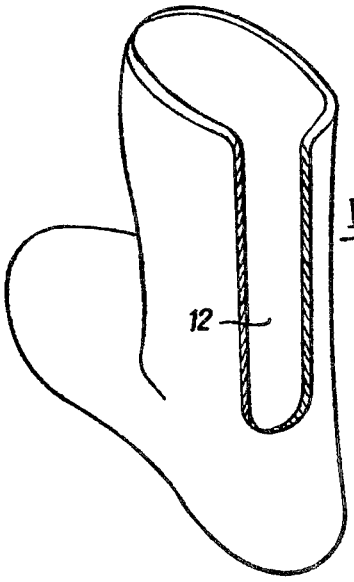
Figure 5:
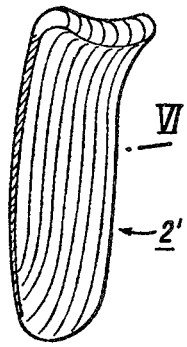
Figure 7:
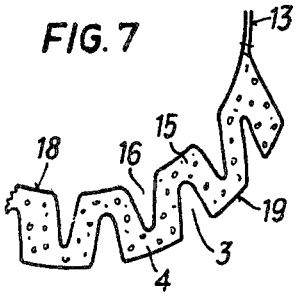
FIG. 7 is a sectional view which is similar to FIG. 6 but shows the laminated portion in an extended state.
Figure 6:
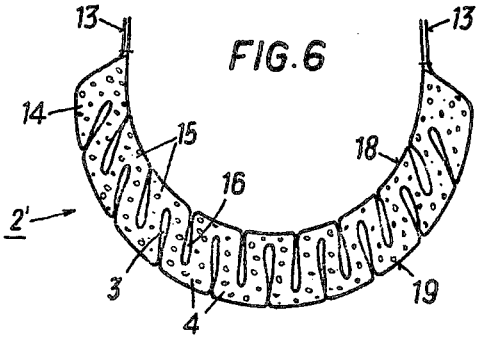
FIG. 6 is a sectional view taken on line VI—VI in FIG. 5.
Figure 10:
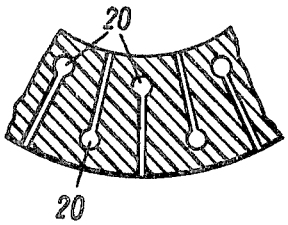
FIG. 10 shows a detail.

The inner shoe shown in FIG. 4 has adjacent to the Achilles' tendon an aperture 12, which receives the laminated portion 2'. The laminated portion 2' can be joined to the edge of the aperture 12 by lockstitching or seamwelding. As is shown in FIG. 6, the laminated portion 2' may be provided with protruding edge portions 13 for that purpose. FIG. 6 is a transverse sectional view showing the laminations of the portions 2 and 8 of FIG. 5. Just as the non-laminated wall portions 1, the laminated wall portion 1 consists of an injection molding of closed-cell foamed plastics material to form the slots 16 extending from the inside 15 of the inner shoe and the slots 3 extending from the outside of the inner shoe, ribs are provided in the injection mold. The slots do not extend throughout the wall thickness, and adjacent laminations 4 are joined by bridges 17 at the bottom of each slot. These bridges 17 hold the laminations in the arrangement which is shown in FIG. 6 and in which they are in sealing contact with each other. When the laminated portion is stretched transversely to the laminations 4, the slots 3 and 16 gape, as is shown in FIG. 7. A lining 18 consisting, e.g. of silk, is provided on the inside of the laminated portion 2' and has been foled into the slots 16 to line the same. On the outside of the portion 2', there is also a lining 19, which covers the laminations and lines the slots. This can be accomplished in a simple manner in that the injection mold provided with the ribs or plates for molding the laminations is covered with the lining material. The edges of the lining materials 18 and 19 protrude to form the protruding edge portions 13. FIG. 10 shows a desirable slot configuration comprising grooves 20 which are circular in cross-section and enlarge the slot in width adjacent to its bottom. This design of the slot adjacent to its bottom prevents a tearing at the slot.

The laminated portions 2 and 8 shown in FIGS. 1, 2 and 3 are formed as shown in FIG. 6. The laminations 4 and 9 and the slots 3 and 10 always extend transversely to the peripheral direction of the inner shoe, the slots 3 and laminations 4 being approximately vertical and the slots 10 and laminations 9 being approximately parallel to the instep line.

Figure 8:
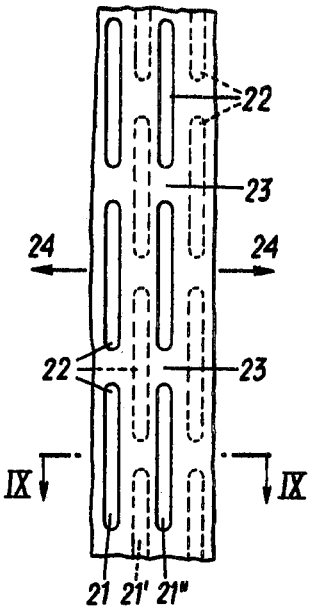
FIG. 8 is a fragmentary view showing part of a differently designed portion having a higher extensibility.

FIG. 8 shows an embodiment in which the portion having a higher extensibility has slots 22, which are arranged in rows 21,21',21'' etc. and extend only in part of the thickness of the wall and are separated by webs 23.

Figure 9:
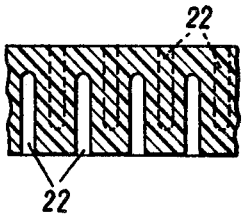
FIG. 9 is a transverse sectional view taken on line IX—IX in FIG. 8.

The portion is extensible because the slots 22 can be pulled apart by tension applied in the direction of arrows 24. FIG. 9 is a transverse sectional view showing that embodiment. The slots 22 may have any desired configuration, e.g. a meandering configuration, which facilitates an elastic deformation in the longitudinal direction of the slots.

The portions 2 and 8 having a higher extensibility reduce the strength of the inner shoe. To facilitate the stepping of the foot into the inner shoe, the latter is provided at its non-laminated wall portions 1 with pull-on straps 25 on both sides.

In the inner shoe shown in FIG. 1, the non-laminated portion 1 contains a reinforcement 26, which may consist of a stiffer material, which can distribute pressures, e.g., of plastics material in the form of sheeting or in other form.

The inner shoes shown in FIGS. 1 and 3 have two steps 27 and 28 at the rear end and a step 29 at the tip. These steps are adapted to snap into recesses of the shellike upper.

In FIG. 3, dotted lines indicate the laminated portions 2 and 8 in an extended condition, in which the slots are in positions 3' and 10' and the laminations in positions 4' and 9'. This extensibility adversely affects the fit of the foot in the inner shoe. For this reason it may be desirable to provide the skiing boot shown in FIG. 3 above the ankle with a bandage, which consists of a band 32 and is adapted to be closed with a bur fastener 33.

The non-laminated wall portion 1 of the inner shoe shown in FIG. 2 is provided adjacent to the instep with a pocket 34. Through an opening 51, cushioning material can be inserted into said pocket in order to compensate different instep heights.

FIGS. 1 and 3 show soles having a profiled thread 35 so that the inner shoe can be worn without the shellike upper. Slipping is prevented by non-skid steps indicated at 36 and 37.

Figure 11:
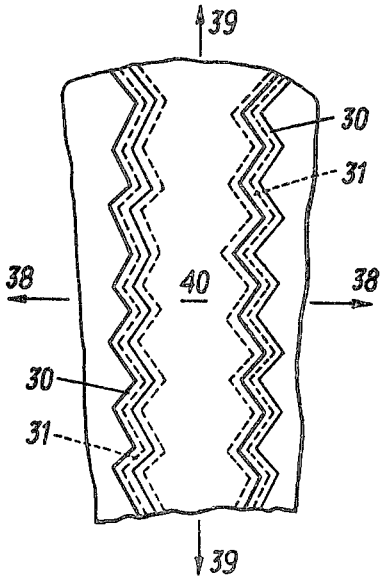
FIG. 11 is a rear elevation showing an inner shoe having a laminated rear portion.
Figure 12:
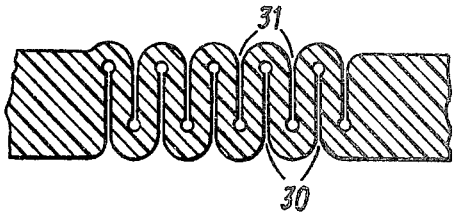
FIG. 12 is a transverse sectional view showing a laminated portion.

The inner shoe shown in FIG. 11 is provided at the rear with meandering slots 30, 31, which permit of an extension in the direction of the arrows 38, i.e., in the peripheral direction of the upper, and in the direction of the arrows 39, i.e., in the upward direction of the upper. The extensibility in the direction of the arrows 39, i.e., in the upward direction of the upper, affords the advantage that a formation of wrinkles in the sock at the foot of the wearer can be prevented. In this embodiment, the meandering slots 30 are open on the outside of the inner shoe and the slots 31 are open on the inside of the inner shoe. The inner shoe is non-laminated in its portion 40, which covers the Achilles' tendon. FIG. 12 is a transverse sectional view showing the slots 30 and 31 on an enlarged scale.

Figure 13:
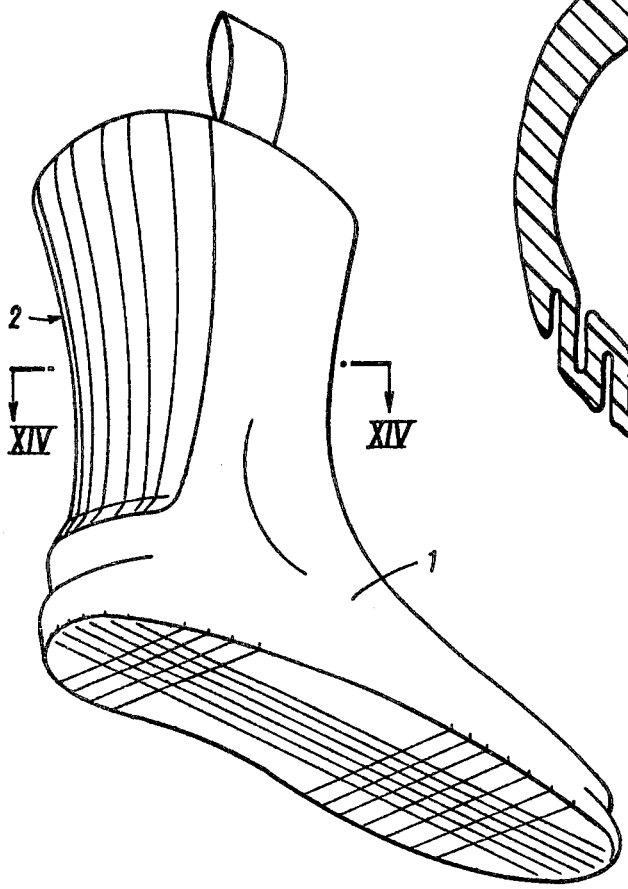
FIG. 13 is an elevation showing a modified inner shoe.
Figure 14:
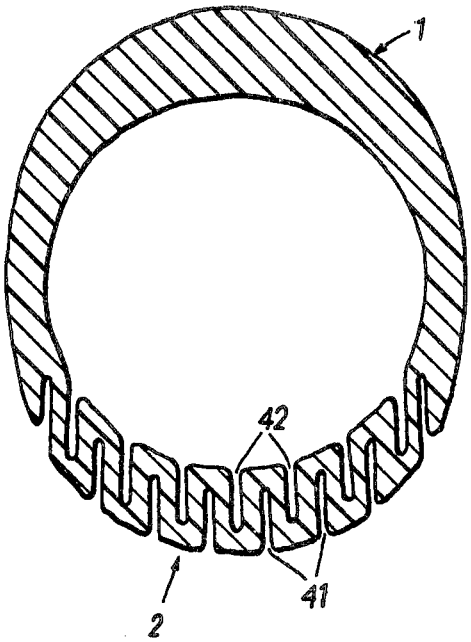
FIG. 14 is a sectional view taken on line XIV—XIV in FIG. 13.
Figure 15:
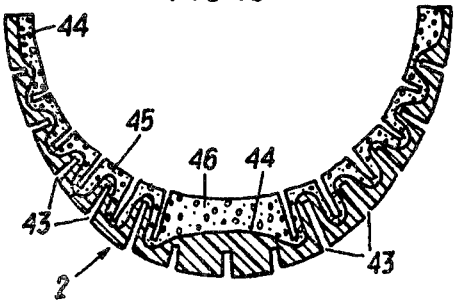
FIG. 15 is a sectional view which is similar to FIG. 14 and shows a modified embodiment and FIG. 16 is a sectional view which is similar to FIG. 14 and shows a further embodiment of the inner shoe.
Figure 16:
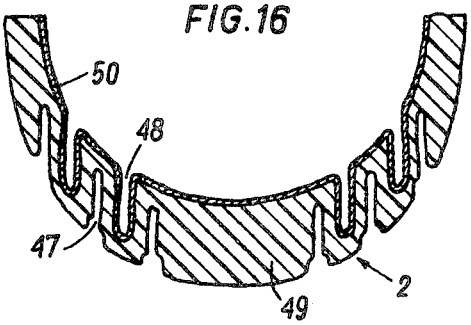

FIG. 13 shows an inner shoe having a laminated portion 2, which is integral with the wall portions 1 of the inner shoe. As is apparent from the transverse sectional view of FIG. 14, the rear portion 2 is provided in its outside surface with approximately parallel slots 41 and in its inside surface with incisions 42, which are also approximately parallel and extend into the material of the wall. In the embodiment shown in FIG. 15, the slots 43 which are open on the outside of the inner shoe have an irregular configuration and extend approximately radially. In this embodiment, the laminated portion differs from that of the other embodiments in that a textile backing 44 is provided on the inside of the laminated portion and the inside surface of the inner shoe consists of an additional elastic layer 45, which has been injection-molded on the backing. In this embodiment, the elastic layer 45 consists of a special foamed material which like a flowable material is easily deformable and when deformed has a higher dimensional stability than a normal foamed material. When such special foamed material is suddenly relaxed, it takes much more time to recover its original shape than a usual foamed material, and when the material is loaded those portions thereof which are more compressed exert on the foot of the wearer approximately the same elastic restoring force as the less compressed portions of this foamed material. In the present embodiment, the laminated portion 2 has adjacent to the Achilles' tendon a middle portion 46 which is free from incisions so that an application of local pressure near the Achilles' tendon by the folds is avoided, FIG. 16 is a transverse sectional view showing a laminated rear portion 2 which has a number of irregularly shaped slots 47 and 48, which are substantially parallel to each other and are open in alternation on the inside and outside of the inner shoe. The middle portion 49 covering the Achilles' tendon is again free from slots. This laminated portion 2 is provided on the inside with lining material 50, which extends into the slots 48 and constitutes a continuous liner on the laminated portion.

We claim:

1. An inner shoe for skiing boots or for use with shellike uppers of skiing boots, said inner shoe comprising: a foot portion having a sole, a heel and an instep; and a wall which consists at least in part of porous, foamed, closed-cell elastic material, said wall being peripherally entirely closed and having above the sole adjacent to at least one of said heel and said instep of the foot portion a portion which extends as far as to the upper edge of the inner shoe and has in the peripheral direction a higher extensibility, than the remaining portions of said wall, said wall portion being divided into laminations which extend transversely to the peripheral direction and are joined in alternation on the inside and outside of the inner shoe to form accordion folds, said laminations when relaxed being in sealing contact with one another at least on the inner side of the inner shoe.

2. An inner shoe as in claim 1 wherein the laminations when relaxed are in sealing contact with each other also on the outside of the inner shoe.

3. An inner shoe as in claim 1 wherein said wall portion consists of a material which has the same compressibility as the material of the remaining wall portion of the inner shoe.

4. An inner shoe as in claim 1 wherein said wall portion is adjacent said heel and extends along the Achilles' tendon only as far as to the upper portion of said heel.

5. An inner shoe as in claim 1 wherein said wall portion is a separate part, and wherein said inner shoe has an aperture which conforms to and receives said separate part, said separate part being joined to the edges of said aperture.

6. An inner shoe as in claim 1 wherein said laminations are defined by slots which have a depth that is smaller than the thickness of the wall.

7. An inner shoe as in claim 6 including a lining of flexible material as least on the inside of the inner shoe and covering said laminations and lines the slots.

8. An inner shoe as in claim 6 wherein said slots are enlarged in width near their bottom by the provision of grooves which are rounded in cross-section.

9. An inner shoe as in claim 6 wherein said wall portion is adjacent said heel and wherein said slots extend adjacent to the Achilles' tendon only on the right and left of the latter and wherein said wall portion comprises a vertical strip which is free from slots and extends along the Achilles' tendon.

10. An inner shoe as in claim 1 wherein said wall portion has slots which are separated by webs and are arranged in rows which extend transversely to the peripheral direction, the depth of said slots being smaller than the thickness of said wall portion, the webs between slots of adjacent rows being staggered, and the slots of adjacent rows extending in alternation from the inside and the outside of the wall portion.

11. An inner shoe as in claim 10 wherein said slots have a meandering configuration.

12. An inner shoe as in claim 1 wherein said inner shoe is made by injection molding plastics material into a mold into contact with a lining which has been laid in the mold to form folds.

13. An inner shoe as in claim 1 including an inside lining made of a foamed material which after a deformation exhibits a delayed recovery to its original shape and which in a deformed state exerts in all portions of its surface approximately equal elastic restoring forces regardless of the reduction of its thickness.

14. An inner shoe as in claim 1 having an instep, said shoe being surrounded above said instep by a bandage comprising a band provided with a bur fastener.

15. An inner shoe as in claim 1 having a lower portion provided with at least one step which is adapted to be snapped into at least one recess of a shellike upper.

16. An inner shoe as in claim 1 having an upper edge provided with at least one pull-on strap outside said wall portion.

17. An inner shoe as in claim 1 having at least one pocket which serves to receive cushioning material and which is disposed outside said wall portion.

* * * * *